US009920700B2

(12) United States Patent
Döring

(10) Patent No.: US 9,920,700 B2
(45) Date of Patent: Mar. 20, 2018

(54) METHOD FOR OPERATION OF AN INTERNAL COMBUSTION ENGINE

(71) Applicant: MAN DIESEL & TURBO SE, Augsburg (DE)

(72) Inventor: Andreas Döring, Muechen/Unterhaching (DE)

(73) Assignee: MAN Diesel & Turbo SE, Augsburg (DE)

( * ) Notice: Subject to any disclaimer, the term of this patent is extended or adjusted under 35 U.S.C. 154(b) by 11 days.

(21) Appl. No.: 14/908,594

(22) PCT Filed: Jul. 28, 2014

(86) PCT No.: PCT/EP2014/066207
§ 371 (c)(1),
(2) Date: Jan. 29, 2016

(87) PCT Pub. No.: WO2015/014809
PCT Pub. Date: Feb. 5, 2015

(65) Prior Publication Data

US 2016/0169134 A1 Jun. 16, 2016

(30) Foreign Application Priority Data

Jul. 29, 2013 (DE) ..... 10 2013 012 568

(51) Int. Cl.
*F02D 41/00* (2006.01)
*F02B 77/08* (2006.01)
(Continued)

(52) U.S. Cl.
CPC ..... *F02D 41/0085* (2013.01); *F02B 5/02* (2013.01); *F02B 77/086* (2013.01);
(Continued)

(58) Field of Classification Search
CPC ..... F02D 41/008; F02D 41/0085; F02D 41/1441; F02D 41/1443; F02D 41/1444;
(Continued)

(56) References Cited

U.S. PATENT DOCUMENTS 5,363,648 A 11/1994 Akazaki et al.
5,651,353 A 7/1997 Allston
(Continued)

FOREIGN PATENT DOCUMENTS

AT 506 085 A4 6/2009
DE 19903721 C1 7/2000
(Continued)

OTHER PUBLICATIONS

Office Action dated Apr. 3, 2017 which issued in the corresponding Korean Patent Application No. 10-2016-7005317.
(Continued)

*Primary Examiner* — John Kwon
*Assistant Examiner* — Johnny H Hoang
(74) *Attorney, Agent, or Firm* — Cozen O'Connor

(57) ABSTRACT

A method for operating an internal combustion engine having a plurality of cylinders includes: measuring, by exhaust gas sensors arranged at an exhaust gas of every cylinder for which cylinder-specific combustion control is carried out, for each respective cylinder, at least one actual combustion value; comparing each respective measured actual combustion value with a reference combustion value to determine at least one cylinder-specific control deviation for every cylinder for which cylinder-specific combustion control is carried out; determining at least one cylinder-specific control variable for every cylinder for which cylinder-specific combustion control is carried out based on the cylinder-specific control deviation or on every cylinder-specific control deviation; and operating each cylinder for
(Continued)

which cylinder-specific combustion control is carried out based on the respective cylinder-specific control variable to bring the respective actual combustion value closer to the respective reference combustion value and minimize the respective control deviation.

13 Claims, 2 Drawing Sheets

(51) Int. Cl.
*F02D 41/22* (2006.01)
*F02D 41/14* (2006.01)
*F02B 5/02* (2006.01)

(52) U.S. Cl.
CPC ..... *F02D 41/008* (2013.01); *F02D 41/1441* (2013.01); *F02D 41/1443* (2013.01); *F02D 41/1454* (2013.01); *F02D 41/1461* (2013.01); *F02D 41/22* (2013.01)

(58) Field of Classification Search
CPC .. F02D 41/1454; F02D 41/1461; F02D 41/22; F02B 5/22; F02B 77/086
USPC ..... 123/406.14, 406.26, 435, 436, 673, 674; 701/101–105, 108, 109, 111, 114, 115
See application file for complete search history.

(56) References Cited

U.S. PATENT DOCUMENTS 6,325,056 B1 12/2001 Weining et al.
8,032,293 B2 10/2011 Binder et al.
2006/0016440 A1* 1/2006 Labbe ..... F02D 41/008 123/673
2006/0137669 A1 6/2006 Lindner
2009/0259385 A1* 10/2009 Loeffler ..... F02D 35/023 701/102
2012/0095668 A1* 4/2012 Landsmann ..... F02D 35/023 701/103
2012/0221227 A1* 8/2012 Alfieri ..... F02D 35/023 701/104
2012/0255532 A1 10/2012 Kawakatsu

FOREIGN PATENT DOCUMENTS

DE 102006016020 B3 2/2007
DE 10 2005 058 820 A1 6/2007
JP H 01-92587 4/1989
JP H 01-203622 8/1989
JP H 02-264137 10/1990
JP H 06-200802 7/1994
JP 2885813 4/1999
JP 2005-273532 10/2005
JP 2008-525710 7/2008
JP 2010-196526 9/2010
JP 2011-132860 7/2011
JP 2011-247214 12/2011
JP 2012-219683 11/2012
WO WO 90/02874 3/1990

OTHER PUBLICATIONS

Office Action dated Jun. 12, 2017 which issued in the corresponding Chinese Patent Application No. 201480043134.X.

* cited by examiner

METHOD FOR OPERATION OF AN INTERNAL COMBUSTION ENGINE

CROSS-REFERENCE TO RELATED APPLICATIONS

This is a U.S. national stage of application No. PCT/EP2014/066207, filed on 28 Jul. 2014, which claims priority to the German Application No. 10 2013 012 568.5, filed 29 Jul. 2013, the content of both incorporated herein by reference.

BACKGROUND OF THE INVENTION

1. Field of the Invention

The invention is directed to a method for the operation of an internal combustion engine having a plurality of cylinders, namely, a method for cylinder-specific combustion control in at least some cylinders, preferably all of the cylinders, of the internal combustion engine.

2. Description of the Related Art

Internal combustion engines must meet increasingly stricter emission limit values. One possibility for meeting these emission limit values is to optimize the operation of the internal combustion engine by a control. In this regard, it is also already generally known in internal combustion engines to control the individual cylinders of the internal combustion engine individually.

DE 10 2005 058 820 A1 discloses a method for operation of an internal combustion engine, particularly a self-igniting internal combustion engine, in which at least one quantity characterizing a respective course of combustion in an associated combustion chamber is calculated in a cylinder-specific manner. The controlling of cylinder-specific fuel injection parameters is influenced depending on this at least one quantity characterizing the combustion curve. This is carried out in that a cylinder pressure is measured at the cylinders so that a quantity characterizing the combustion in the respective cylinder can be calculated depending on the cylinder pressure measurement. Actual combustion values calculated in this way are compared with corresponding reference combustion values in order to influence cylinder-specific fuel injection parameters depending on a control deviation as control variables for the cylinders.

When the actual combustion values are calculated, for example, from the measured cylinder pressure as proposed in DE 10 2005 058 820 A1, the combustion in the cylinders of the internal combustion engine can only be optimized to a limited extent for complying with emission limit values. This is because, among other things, no information about wear or about changes in the injection characteristics of fuel injection nozzles can be gained from the cylinder pressure.

SUMMARY OF THE INVENTION

Against this background, an object of the present invention is to provide a novel method for operating an internal combustion engine by which a cylinder-specific control of the cylinders of the internal combustion engine can be improved.

This object is met though a method for the operation of an internal combustion as set forth below.

According to one aspect of the invention, by at least one exhaust gas sensor at the exhaust gas of every cylinder of the internal combustion engine for which a cylinder-specific combustion control is carried out, at least one actual combustion value is measured individually for the respective cylinder, and the respective measured actual combustion value is compared with a reference combustion value to determine at least one cylinder-specific control deviation between the reference combustion value and the actual combustion value for each of the cylinders for which a cylinder-specific combustion control is carried out, wherein at least one cylinder-specific control variable is determined for every cylinder for which a cylinder-specific combustion control is carried out based on the cylinder-specific control deviation or based on every cylinder-specific control deviation, the respective cylinder being controlled or operated on the basis of this cylinder-specific control variable to bring the respective actual combustion value closer to the respective reference combustion value and minimize of the respective control deviation.

For those cylinders for which a cylinder-specific combustion control is to be carried out, individual measuring of at least one actual combustion value for the respective cylinder may be performed. Thus, according to an aspect of the invention, an actual combustion value is not calculated from other measured quantities but rather is measured individually for each cylinder. A cylinder-specific actual combustion value of the respective cylinder measured in this way is then compared with a corresponding reference combustion value to determine a control deviation in a cylinder-specific manner and to determine, on the basis of this cylinder-specific control deviation, a cylinder-specific control variable for the respective cylinder so that the actual combustion value can be brought closer to the reference combustion value of the respective cylinder. In this way, the operation of an internal combustion engine can be appreciably improved over known cylinder-specific controls. In particular, it is possible to compensate for wear or a change in the injection behavior of fuel injection nozzles via the control.

According to a first advantageous further development of the invention, the actual combustion value or every actual combustion value is measured by at least one cylinder-specific exhaust gas sensor for every cylinder for which a cylinder-specific combustion control is carried out, wherein the respective actual combustion value is acquired at the respective exhaust gas sensor of the respective cylinder exclusively in a cylinder-specific crankshaft angle range so as to minimize an interaction with the exhaust gas expelled from other cylinders during the cylinder-specific acquisition of the actual combustion value. According to a second alternative advantageous further development of the invention, the actual combustion value or every actual combustion value is measured by a shared exhaust gas sensor for a plurality of cylinders for which a cylinder-specific combustion control is carried out, wherein the exhaust gas of always exclusively one cylinder is supplied to the shared exhaust gas sensor of a plurality of cylinders so as to minimize interaction with the exhaust gas expelled from other cylinders during the cylinder-specific acquisition of the actual combustion value.

Both the first advantageous further development of the invention and the second alternative advantageous further development of the invention allow an exactly measured determination of cylinder-specific actual combustion values, specifically without the risk that the measurement of an actual combustion value taken at the exhaust gas of a cylinder is impaired by interaction with the exhaust gas expelled by other cylinders.

The reference combustion value of the cylinders is preferably dependent on the operating point of the internal combustion engine. The use of reference combustion values that depend on the operating point is preferred because then an optimal operation of the internal combustion engine can be ensured via a cylinder-specific combustion control for different operating points.

According to another advantageous further development of the invention, an actual NOx value is acquired as actual combustion value for every cylinder for which a cylinder-specific combustion control is carried out by an exhaust gas sensor configured as a NOx sensor. In addition or alternatively, a fuel-air ratio or residual oxygen content is acquired as an actual combustion value for every cylinder for which a cylinder-specific combustion control is carried out by an exhaust gas sensor configured as a lambda sensor. The measurement of the cylinder-specific actual combustion value via NOx sensors or lambda sensors is preferred.

BRIEF DESCRIPTION OF THE DRAWINGS

Embodiment examples of the invention are described more fully with reference to the drawings without the invention being limited to these embodiment examples. In the drawings.

DETAILED DESCRIPTION OF THE PREFERRED EMBODIMENTS

The invention is directed to a method for operating an internal combustion engine, namely a method for cylinder-specific combustion control at the cylinders of an internal combustion engine.

Figure 1:
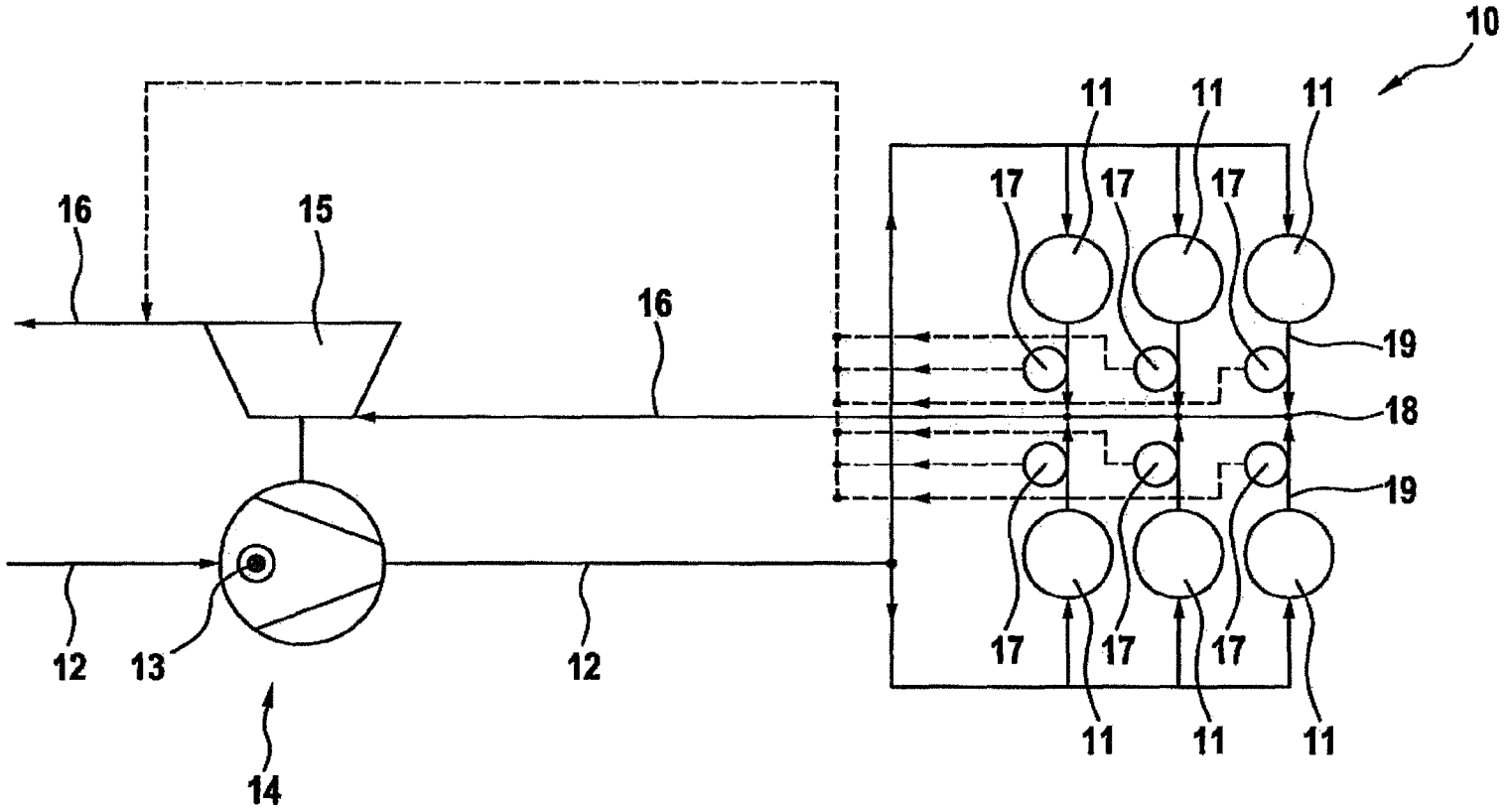
FIG. 1 shows a schematic view of an internal combustion engine with a plurality of cylinders and with an exhaust gas turbocharger device for purposes of illustration.

FIG. 1 shows a highly schematic diagram of an internal combustion engine 10 with a plurality of cylinders 11. The quantity of six cylinders 11 shown in FIG. 1 and the grouping of these cylinders 11 into two cylinder groups is purely exemplary. Charge air can be supplied to the cylinders 11 of the internal combustion engine 10 proceeding from a charge air line 12. In the embodiment example shown in FIG. 1, the charge air is compressed in a compressor 13 of an exhaust gas turbocharger 14. Energy required for this purpose is obtained in a turbine 15 of the exhaust gas turbocharger in that exhaust gas exiting the cylinders 11 of the internal combustion engine 10 is expanded in the turbine 15. Accordingly, the turbine 15 of the exhaust gas turbocharger 14 can supply the exhaust gas exiting the cylinders 11 via an exhaust gas line 16.

In disclosed embodiments of the present invention, a cylinder-specific combustion control may be carried out at an internal combustion engine 10. For this purpose, by at least one exhaust gas sensor 17 at the exhaust gas of every cylinder 11 for which a cylinder-specific combustion control is to be carried out, at least one actual combustion value is measured individually for the respective cylinder 11. This respective measured actual combustion value of the respective cylinder 11 is compared with a corresponding reference combustion value so that a cylinder-specific control deviation between the reference combustion value and the measured actual combustion value is determined for the respective cylinder for which a cylinder-specific combustion control is carried out.

Based on this cylinder-specific control deviation, a cylinder-specific control variable is determined for every cylinder for which a cylinder-specific combustion control is to be carried out, the respective cylinder 11 being controlled or operated on the basis of this cylinder-specific control variable to bring the respective actual combustion value closer to the respective reference combustion value while minimizing the respective control deviation.

According to FIG. 1, an individual exhaust gas sensor 17 is associated with every cylinder 11 of the internal combustion engine 10. Viewed in the flow direction of the exhaust gas, every cylinder-specific exhaust gas sensor 17 is arranged downstream of the respective cylinder 11 and upstream of a combining point 18 of a cylinder-specific exhaust gas outlet channel 19 and the exhaust gas line 16. It is also possible for the exhaust gas sensors 17 to project into combustion chambers of the cylinders 11.

In the region of every cylinder-specific exhaust gas sensor 17, the exhaust gas of the respective cylinder 11 is subjected to a cylinder-specific measurement to determine at least one cylinder-specific actual combustion value for every cylinder 11. In so doing, it is provided that the respective actual combustion value is acquired exclusively in a cylinder-specific crankshaft angle range at the respective exhaust gas sensor 17 of the respective cylinder 11 in order to minimize interaction with the exhaust gas expelled by other cylinders during the cylinder-specific acquisition of the actual combustion values or, if feasible, even to completely prevent any overlap between outlet valves. Since the outlet valves of the individual cylinders 11 open in different crankshaft angle ranges and accordingly carry off exhaust gas from the respective cylinders 11 in different crankshaft angle ranges, the exhaust gas of other cylinders can be prevented from impairing this actual value acquisition during acquisition of cylinder-specific actual combustion values.

According to FIG. 1, the exhaust gas conducted via the cylinder-specific exhaust gas sensors 17 is guided downstream of the turbine 15 into the exhaust gas line 16 viewed in flow direction of the exhaust gas.

Figure 2:
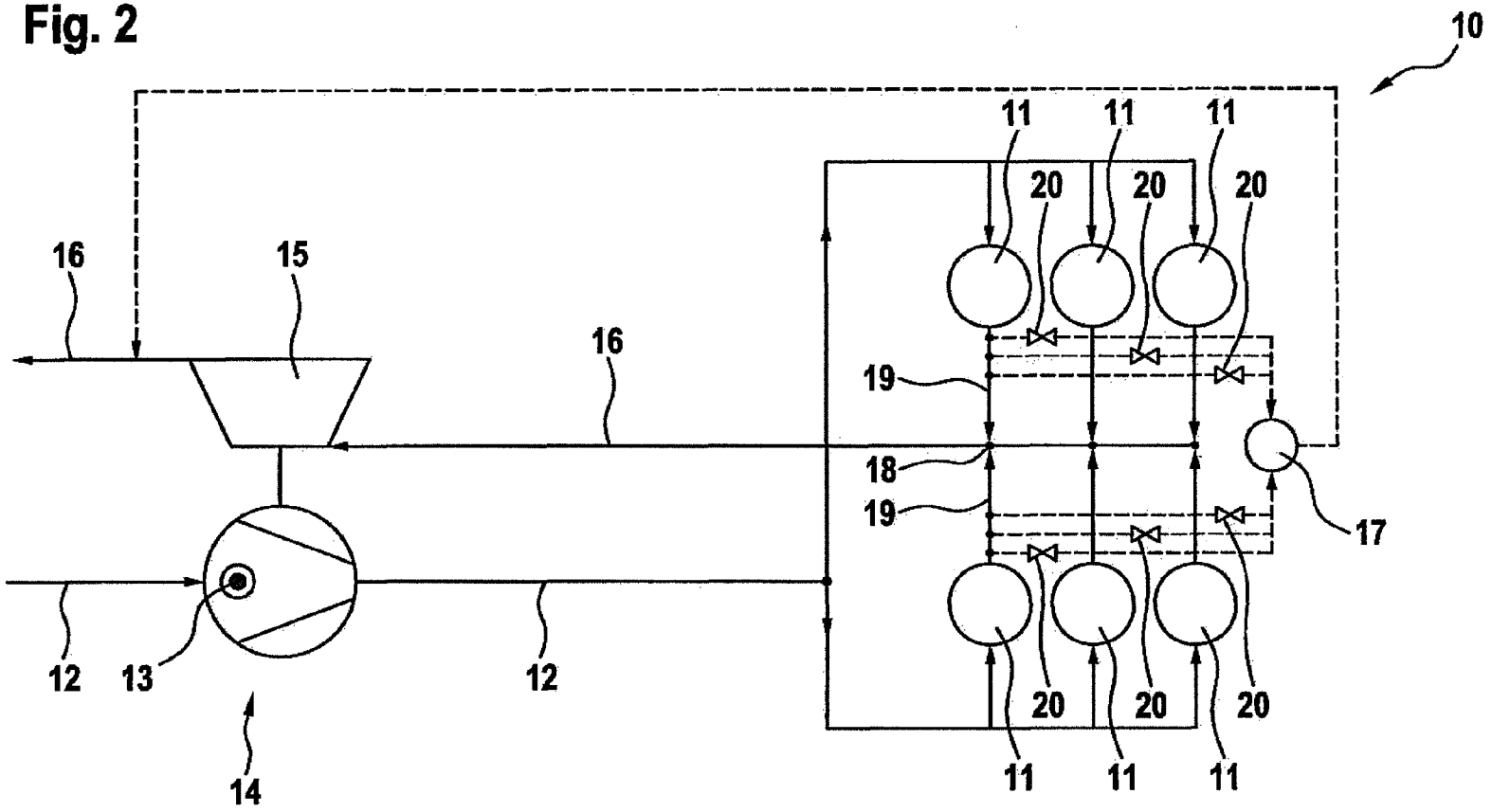
FIG. 2 shows a schematic view of a further internal combustion engine with a plurality of cylinders and with an exhaust gas turbocharger device for illustrating the method according to the invention.

FIG. 2 shows an alternative embodiment in which a shared exhaust gas sensor 17 is provided for determining the cylinder-specific actual combustion values for the cylinders for which a cylinder-specific combustion control is carried out. This exhaust gas sensor 17 is coupled in each instance with the cylinder-specific exhaust gas outlet channels 19 with the intermediary of valves 20 so that the exhaust gas of always exclusively one cylinder 11 is supplied to the shared exhaust gas sensor 17. The control of the valves 20 is carried out again depending on the cylinder-specific crankshaft angle range so that when the outlet valves of the respective cylinder 11 expel exhaust gas, exhaust gas of the respective cylinder 11 is supplied to the shared exhaust gas sensor 17 in that the valve 20 associated with this respective cylinder 11 opens. Also, in the embodiment example in FIG. 2, the exhaust gas guided via the shared exhaust gas sensor 17 is guided into the exhaust gas line 16 downstream of the turbine 15 of the exhaust gas turbocharger 14.

In the variants in FIGS. 1 and 2, running times of the exhaust gas from the cylinders 11 to the exhaust gas sensors 17 can be taken into account during the acquisition of the actual value.

The cylinder-specific exhaust gas sensors 17 in FIG. 1 and the shared exhaust gas sensor 17 in FIG. 2, which are used, respectively, for the cylinder-specific determination of an actual combustion value can be NOx sensors and/or lambda sensors.

When NOx sensors are used as exhaust gas sensors in FIG. 1 and an NOx sensor is used as shared exhaust gas sensor in FIG. 2, a difference between a reference NOx value and a cylinder-specific measured actual NOx value is determined as a cylinder-specific control deviation.

When this control deviation is greater than zero, i.e., when the reference NOx value is greater than the actual NOx value, an injection pressure of the respective cylinder as control variable for the respective cylinder 11 is preferably increased and/or a start of injection in the respective cylinder 11 as a control variable for the respective cylinder 11 is preferably retarded and/or an ignition time of the respective cylinder 11 as a control variable for the respective cylinder 11 is preferably retarded and/or a pre-injection into the respective cylinder 11 as a control variable for the respective cylinder 11 is preferably disabled and/or a post-injection into the respective cylinder 11 as a control variable for the respective cylinder 11 is preferably enabled. Conversely, when the cylinder-specific control deviation between the reference NOx value and the measured actual NOx value is less than zero, i.e., when the actual NOx value is greater than the reference NOx value, the injection pressure of the respective cylinder 11 as a cylinder-specific control variable is reduced and/or the start of injection into the respective cylinder 11 as a cylinder-specific control variable is advanced and/or the ignition time of the respective cylinder 11 as a cylinder-specific control variable is advanced and/or the pre-injection into the respective cylinder 11 as a cylinder-specific control variable is enabled and/or the post-injection into the respective cylinder 11 as a cylinder-specific control variable is disabled. The selection of the control variable depends on the construction type of the respective internal combustion engine 10, particularly on whether the internal combustion engine 10 to be operated is self-igniting or externally ignited.

When a lambda sensor is used as exhaust gas sensors 17 in FIG. 1 or as shared exhaust gas sensor 17 in FIG. 2, fuel-air ratios or residual oxygen contents are preferably determined as cylinder-specific actual combustion value. When a cylinder-specific control deviation between the reference value and the actual value of the cylinder-specific fuel-air ratio is greater than zero, a fuel injection amount in the respective cylinder 11 as a control variable is preferably increased and/or a throttling of a charge air supply to the respective cylinder 11 as a control variable is preferably reduced. Conversely, when the cylinder-specific control deviation between the reference value and the actual value of the fuel-air ratio is less than zero, a fuel injection amount into the respective cylinder 11 as a cylinder-specific control variable is preferably reduced and/or the throttling of the charge air supply to the respective cylinder 11 as a cylinder-specific control variable is preferably increased.

During the measurement of the actual combustion values, it is possible either to use the current measurement of the actual combustion value or to determine an average value or a maximum value or a time integral from measurements of the actual combustion value acquired over a measurement interval and to use this value as cylinder-specific actual combustion value. It is also possible to use an inflection point within a measurement interval as cylinder-specific actual combustion value.

In relatively rapidly running internal combustion engines, the use of average values as actual combustion values is preferred. In relatively slowly running internal combustion engines, the use of maximum values or time integrals or inflection points as actual combustion values is preferred.

According to another advantageous further development of the invention, it is provided that reference combustion values that depend on the operating point of the internal combustion engine 10 are used as reference combustion values for the cylinders 11 of the internal combustion engine 10.

Accordingly, it is possible to reserve different reference combustion values for the cylinders 11 of the internal combustion engine 10 for a full load operation and a partial load operation of the internal combustion engine 10. Accordingly, an optimal operation of the internal combustion engine 10 for the different operating points of the internal combustion engine 10 can be ensured in order to comply with exhaust gas emission limit values.

The reference combustion values can be cylinder-specific reference combustion values or reference values that are identical for all of the cylinders 11 of the internal combustion engine 10.

A plurality of actual combustion values can also be determined for every cylinder 11 so as to compare them with corresponding reference combustion values and, depending thereon, to determine at least one cylinder-specific control variable on the basis of which the respective cylinder 11 is operated. Actual NOx values can be determined in combination with actual values of the residual oxygen content or fuel-air ratio and compared to corresponding reference values. In this connection, NOx sensors and lambda sensors can form a unit which cannot be separated without destroying it.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

LIST OF REFERENCE NUMERALS

10 internal combustion engine
11 cylinder
12 charge air line
13 compressor
14 exhaust gas turbocharger
15 turbine
16 exhaust gas line
17 exhaust gas sensor
18 combining point
19 exhaust gas outlet channel
20 valve

The invention claimed is:

1. A method for operating an internal combustion engine having a plurality of cylinders for cylinder-specific combustion control, the method comprising:

measuring, by a shared exhaust gas sensor coupled at an exhaust gas of every cylinder for which cylinder-specific combustion control is carried out, individually for each respective cylinder, at least one actual combustion value, the shared exhaust gas sensor being coupled to the exhaust gas via cylinder-specific exhaust gas outlet channels and intermediary valves arranged so that the exhaust gas of always exclusively one cylinder is supplied to the shared exhaust gas sensor at any given time, the control of the valves being carried out depending upon a cylinder-specific crankshaft angle range;

comparing each respective measured actual combustion value with a reference combustion value to determine at least one cylinder-specific control deviation between the reference combustion value and the respective actual combustion values for every cylinder for which cylinder-specific combustion control is carried out;

determining at least one cylinder-specific control variable for every cylinder for which cylinder-specific combustion control is carried out based on the respective cylinder-specific control deviation or based on every cylinder-specific control deviation; and operating each cylinder for which cylinder-specific combustion control is carried out based on the determined at least one cylinder-specific control variable to bring the respective actual combustion value closer to the respective reference combustion value and minimize the respective control deviation.

2. The method according to claim 1, wherein the actual combustion value or every actual combustion value is measured by the exhaust gas sensor for every cylinder for which cylinder-specific combustion control is carried out.

3. The method according to claim 2, wherein the respective actual combustion values are acquired at the exhaust gas sensor exclusively in a cylinder-specific crankshaft angle range so as to minimize an interaction with the exhaust gas expelled from other cylinders during the cylinder-specific acquisition of the actual combustion value.

4. The method according to claim 1, wherein the actual combustion value or every actual combustion value is measured by the shared exhaust gas sensor for a plurality of cylinders for which cylinder-specific combustion control is carried out.

5. The method according to claim 4, wherein the exhaust gas of always exclusively one cylinder is supplied to the shared exhaust gas sensor so as to minimize an interaction with the exhaust gas expelled from other cylinders during the cylinder-specific acquisition of the actual combustion value.

6. The method according to claim 1, wherein the reference combustion value of the cylinders is dependent on an operating point of the internal combustion engine.

7. The method according to claim 6, wherein a cylinder-specific reference combustion value is predetermined depending on the operating point of the internal combustion engine for every cylinder for which cylinder-specific combustion control is carried out.

8. The method according to claim 1, wherein an actual NOx value is acquired as the actual combustion value for every cylinder for which cylinder-specific combustion control is carried out by the exhaust gas sensor configured as a NOx sensor.

9. The method according to claim 8, wherein when a cylinder-specific control deviation between the reference NOx value and the actual NOx value is greater than zero, at least one action is carried out selected from the group of actions of:

an injection pressure of the respective cylinder as control variable is increased, a start of injection in the respective cylinder as control variable is retarded, an ignition time of the respective cylinder as control variable is retarded, a pre-injection into the respective cylinder as control variable is disabled, and a post-injection into the respective cylinder as control variable is enabled; and when a cylinder-specific control deviation between the reference NOx value and the actual NOx value is less than zero, at least one action is carried out selected from the group of actions of:

an injection pressure of the respective cylinder as control variable is reduced, a start of injection into the respective cylinder as control variable is advanced, an ignition time of the respective cylinder as control variable is advanced, a pre-injection into the respective cylinder as control variable is enabled, and a post-injection into the respective cylinder as control variable is disabled.

10. The method according to claim 1, wherein a fuel-air ratio or residual oxygen content is acquired as the actual combustion value by the exhaust gas sensor configured as lambda sensor for every cylinder for which cylinder-specific combustion control is carried out.

11. The method according to claim 10, wherein when a cylinder-specific control deviation between the reference value and the actual value of the fuel-air ratio is greater than zero, at least one action is carried out selected from among the group of actions of:

a fuel injection amount in the cylinder as control variable is increased, and a throttling of a charge air supply as control variable is reduced; and when the cylinder-specific control deviation between the reference value and the actual value of the fuel-air ratio is less than zero, at least one action is carried out selected from among the group of actions of:

a fuel injection amount in the cylinder as control variable is reduced, and a throttling of a charge air supply as control variable is increased.

12. The method according to claim 1, wherein a current measurement of the actual combustion value is used as the actual combustion value.

13. The method according to claim 1, wherein an average value or a maximum value or a time integral or an inflection point from measurements acquired over a measurement interval is used as the actual combustion value.

* * * * *